US006505986B1

(12) United States Patent
Oder

(10) Patent No.: US 6,505,986 B1
(45) **Date of Patent: *Jan. 14, 2003**

(54) APPLICATOR SYSTEMS

(75) Inventor: Reuben Earl Oder, Union, KY (US)

(73) Assignee: The Procter & Gamble Company, Cincinnati, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/554,872

(22) PCT Filed: Nov. 20, 1998

(86) PCT No.: PCT/US98/24840

§ 371 (c)(1),
(2), (4) Date: May 19, 2000

(87) PCT Pub. No.: WO99/26511

PCT Pub. Date: Jun. 3, 1999

(30) Foreign Application Priority Data

Nov. 21, 1997 (GB) ..... 9724716

(51) Int. Cl.[7] ..... B43M 11/06

(52) U.S. Cl. ..... 401/183; 401/205; 401/263; 401/186; 222/94; 222/211; 222/213

(58) Field of Search ..... 401/183, 184, 401/185, 205, 263, 186; 222/94, 212, 213, 215, 211, 481, 481.5, 482, 484, 464.1

(56) References Cited

U.S. PATENT DOCUMENTS

| | | | | |
|---|---|---|---|---|
| 2,571,424 A | | 10/1951 | Dailey | |
| 3,097,766 A | | 7/1963 | Biehl | |
| 3,261,381 A | | 7/1966 | Roach | |
| 3,549,050 A | | 12/1970 | Bruce et al. | |
| 4,057,177 A | * | 11/1977 | Laauwe | 222/215 |
| 4,102,476 A | * | 7/1978 | Loeffler | 222/209 |
| 4,147,278 A | | 4/1979 | Uhlig | |
| 4,209,027 A | | 6/1980 | Morganroth | |
| 4,457,455 A | | 7/1984 | Meshberg | |
| 4,469,250 A | | 9/1984 | Evezich | |
| 4,484,697 A | | 11/1984 | Fry, Jr. | |
| 4,602,651 A | | 7/1986 | Roppatte, Jr. | |
| 5,299,877 A | | 4/1994 | Birden | |
| 5,332,121 A | | 7/1994 | Schmidt et al. | |
| 5,558,453 A | | 9/1996 | Bell et al. | |
| 5,604,050 A | | 2/1997 | Brunette et al. | |
| 5,615,803 A | | 4/1997 | Hatakeyama et al. | |
| 6,332,726 B2 | * | 12/2001 | Yamamoto et al. | 401/183 |

FOREIGN PATENT DOCUMENTS

| | | |
|---|---|---|
| EP | 0102797 A2 | 3/1984 |
| EP | 0395380 A2 | 10/1990 |
| EP | 0380251 B1 | 3/1993 |
| EP | 0628495 A1 | 12/1994 |
| WO | WO 88/09632 | 12/1988 |
| WO | WO 90/07290 | 7/1990 |

* cited by examiner

*Primary Examiner*—David J. Walczak
(74) *Attorney, Agent, or Firm*—Andrew A. Paul; Jack L. Oney, Jr.; Leonard W. Lewis

(57) ABSTRACT

An applicator system, for use in delivering a flowable composition, comprising; (a) container including an inner collapsible layer distinct from an outer deformable layer, the inner collapsible layer defining a reservoir, and the outer deformable layer being separated from the inner collapsible layer by a buffer zone; (b) a dispenser including a first passageway distinct from a second passageway, the first passageway being in communication with the buffer zone and the second passageway being in communication with the reservoir; and (c) valve means operable to control entry of air into the buffer zone through the first passageway and exit of flowable composition from the reservoir through the second passageway; wherein the valve means is of unitary construction.

14 Claims, 6 Drawing Sheets

138
114
118
130
58
116
148
144
108
106
78
14
16
72
110
22
84
76
20
34
18
74
28
98
104
94
96
12
42
36
40
26
44
48
38
10
24
30

APPLICATOR SYSTEMS

The present invention relates to applicator systems capable of delivering a flowable composition from a container at any orientation of the container.

An applicator system capable of all orientation delivery is disclosed in JP 7-022951U.

Such an applicator system, hereinafter referred to as an applicator system of the kind described, comprises:

a container including an inner collapsible layer distinct from an outer deformable layer, the inner collapsible layer defining a reservoir, and the outer deformable layer being separated from the inner collapsible layer by a buffer zone;

a dispenser including a first passageway distinct from a second passageway, the first passageway being in communication with the buffer zone and the second passageway being in communication with the reservoir; and valve means operable to control entry of air into the buffer zone through the first passageway and exit of flowable composition from the reservoir through the second passageway.

However, a one-way flapper valve is provided to control the entry of the air into the buffer zone through the first passageway, and a physically separate one-way flapper valve is provided to control the exit of the flowable composition from the reservoir through the second passageway.

It would be commercially desirable if an applicator system of the kind described could be simplified, allowing assembly to be easier and thus allowing manufacture to be more efficient.

Such a simplification is achieved by the present invention, in which an applicator system of the kind described is characterised in that the valve means is of unitary construction.

It would be possible for the container to be a delaminating container, in which the inner collapsible layer progressively peels away from the outer deformable layer, but the inner collapsible layer may alternatively comprise a flexible bag.

Preferably, an inlet part of the valve means controlling the first passageway is a flapper valve.

To avoid reliance on a single air inlet, which may become blocked by any of the flowable composition dripping down the outside of the dispenser, the first passageway may include a plurality of circumferentially spaced air inlets, and the flapper valve may be of annular shape.

Preferably, an outlet part of the valve means controlling the second passageway is a quadrolobe valve a quadrolobe valve opens from the centre, rather than the side, and is thus capable of achieving a smoother flow during exit of the flowable composition from the reservoir.

It will be appreciated that assembly is particularly simple if the valve means is a push fit with the dispenser.

More particularly, the quadrolobe valve may be a push fit within the second passageway.

It will also be appreciated that assembly of the dispenser with the container can be simplified if the dispenser is a simple direct or indirect push fit with the container.

In one arrangement, the dispenser is a push fit within an insert, and the insert is a push fit within a neck of the container, the insert having an annular channel surrounding a tubular member, with the annular channel including at least one opening forming part of the first passageway, and the tubular member contacting the valve means and forming part of the second passageway.

An applicator system, according to the present invention, will now be described in greater detail, by way of example only, with reference to the accompanying drawings, wherein.

Figure 1:
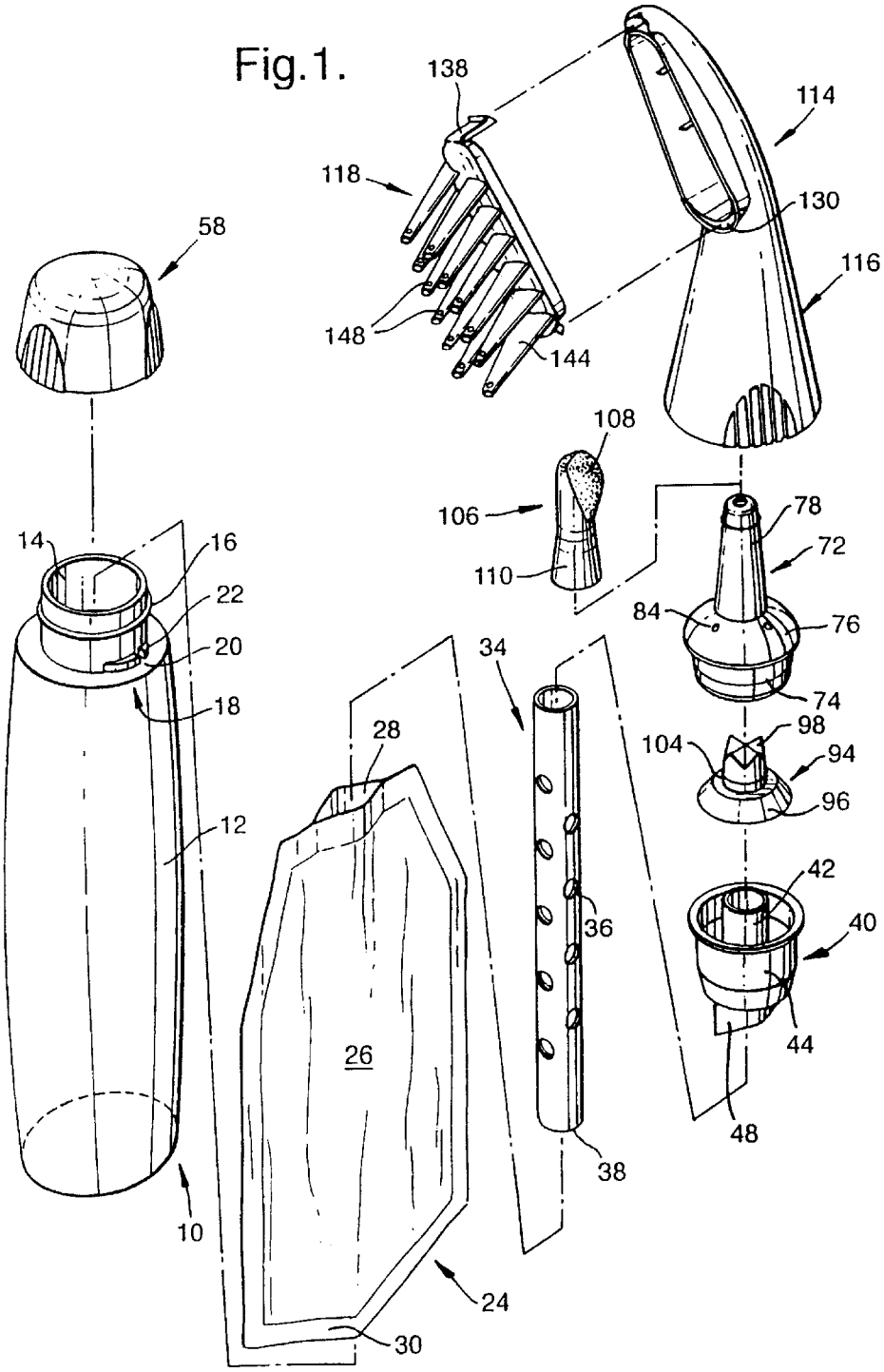
FIG. 1 is an exploded perspective view of a cap, a bottle, a flexible bag, a support tube, an insert, a valve, a spout, a sponge pad, a comb housing and a comb—all being components in a hair colouring kit embodying the present invention.

The accompanying drawings illustrate a hair colouring kit embodying all aspects of the present invention—the different inventive aspects, for which protection is being sought in the present and several contemporaneous patent applications, relate to a delivery system as well as to various applicators and applicator systems for use in delivering a flowable composition.

Although the flowable composition is preferably a hair colouring composition, no aspect of the present invention is restricted to such a specific flowable composition. Other examples of flowable compositions are: medicaments e.g. for petcare; foodstuffs e.g. cake mixes; cleaning fluids e.g. for garmentcare or carpetcare; cosmetics e.g. body lotions or moisturisers; adhesives or lubricants.

Use of a hair colouring composition can be problematical.

One problem is that the hair colouring composition may need to be prepared from two or more component materials just prior to use. This means that the component materials need to be stored separately in a manner allowing a user to mix the component materials when required. Typically, one of the component materials is hydrogen peroxide and another of the component materials is a dye. The user must not, however, be exposed to any danger or any risk of staining when adding the dye to the hydrogen peroxide.

Another problem is that the hair colouring composition may need to be applied to the hair through an applicator at any angle. If the applicator is fed from a simple squeeze bottle, the applicator will be ready for use in any orientation when the squeeze bottle is full. However, as the squeeze bottle is progressively emptied, it is found that the applicator is not ready for immediate use in any orientation, but may first need to be primed to offset the effect of any suckback of the hair colouring composition. This makes it difficult to control the application of the hair colouring composition, particularly to the hairline whilst avoiding staining of the skin.

The present hair colouring kit not only allows the hair colouring composition to be prepared just prior to use, but has applicators fed by a user-controlled delivery system in which the hair colouring composition is discharged by a mechanically generated pressure differential (not an aerosol) in such a way that the hair colouring composition is always ready to be discharged at any orientation of the delivery system.

All orientation delivery is possible for all of the hair colouring composition which is discharged—which can be over 90% or even 95% of the hair colouring composition which has been prepared.

The present hair colouring kit also allows the hair colouring composition to be delivered in user-regulated amounts through applicators to specific areas to achieve an even colour distribution with minimal mess.

No one applicator is equally suitable, even if carefully manipulated, for applying hair colouring composition to the roots, the hairline and the main body of a head of hair. It is therefore usual to provide applicators of different types selected from a line applicator, a surface applicator and a brush/comb-like applicator. The line applicator can be a spout with a single outlet and the surface applicator can be of porous material with a plurality of outlets. The brush/comb-like applicator can have a plurality of outlets for dispensing hair colouring composition which is then dispersed by a plurality of elongate parting members. As might be expected, the elongate parting members might resemble the bristles of a brush or the teeth of a comb. All of the different applicator types are to be brought into fluid communication with a container for the hair colouring composition.

Specific advantages of the present hair colouring kit are that:

(a) only a selected one of three applicators of different type is exposed during use so that there is no risk during manipulation of the hair of mess being caused by any hair colouring composition left in or on the other applicators;

(b) a surface applicator from three applicators of different type is of foam or sponge material having a resiliently compressible porous structure to provide improved spreading of the hair colouring composition; and (c) a brush/comb-like applicator from three applicators of different type has at least two of its outlets formed in respective ones of its elongate parting members to provide improved dispersal of the hair colouring composition.

Other specific advantages of the present hair colouring kit are that a one-piece valve simultaneously performs the dual functions of controlling entry of air and exit of hair colouring composition, a support for elongate parting members is secured to a housing by at least one catch which is releasable from a position remote from the hair colouring composition and, with a line applicator attached to a container, a brush/comb-like applicator is locatable over the line applicator yet is still attachable directly to the container.

Before describing a surface applicator with reference to FIGS. 7 and 8, and a brush/comb-like applicator with reference to FIGS. 9 to 12, a delivery system incorporating a line applicator will be described with reference to FIGS. 1 to 6.

A bottle 10 may be formed with a hollow body 12 which is of generally oval section and is closed at a lower end but has an open neck 14 at an upper end. The neck may be formed with an external thread 16. The neck 14 may also be formed with a pair of opposed lug means 18 of which only one is shown in FIG. 1. Each of the lug means 18 preferably includes a gap 20 approached by a ramp 22 for a purpose to be described hereinafter.

At least the body 12 may be formed of a resiliently deformable plastics material such that the bottle 10 can quickly reform in shape when released from having been squeezed. The plastics material may be low density polyethylene, linear low density polyethylene (LLDPE) or polypropylene and may be transparent. If not transparent, the plastics material is preferably translucent and may or may not be coloured.

A flexible bag 24 may be formed of two overlapping sheets 26 of the same shape which are sealed together around most of their common periphery to form a side sealed sachet having an upper opening 28 and a lower V-shaped edge 30. The bag 24 defines a reservoir for a first material, such as hydrogen peroxide, and should therefore provide a good moisture barrier. Each of the sheets 26 may be of laminated metallised material, and preferably includes the following three layers: LLDPE sealant/adhesive/metallised PET (polyethylterphalate).

Figure 4:
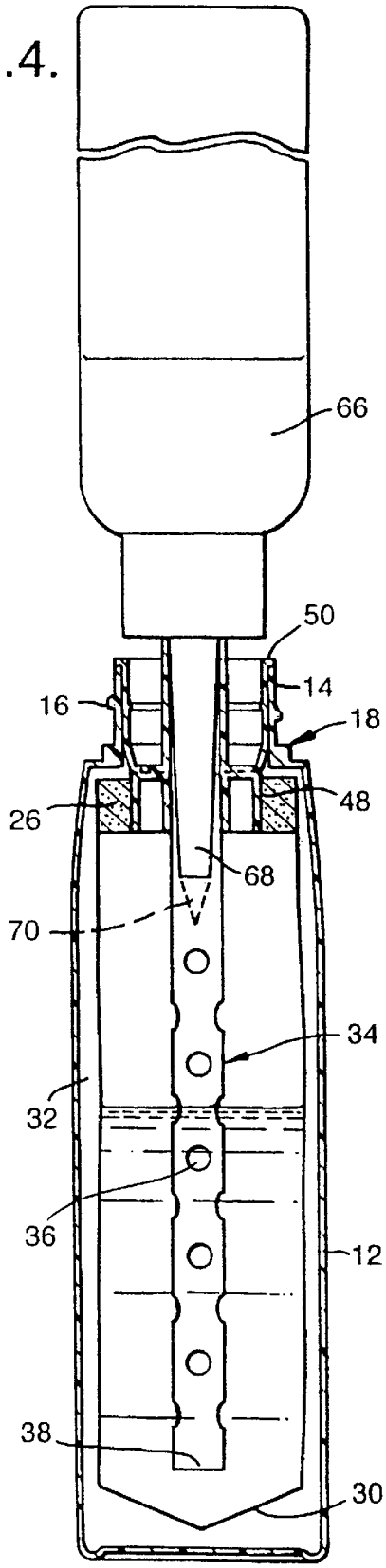
FIG. 4 is a schematic cross-sectional view, taken perpendicularly to the cross-sectional view of FIG. 2, showing a dye container when docked with the insert to allow dye in the dye container to be added to the flexible bag.

The bag 24 is insertable into the bottle 10 through the neck 14 to form a container with an outer deformable layer (body 12) and an inner collapsible layer (sheets 26) separated from one another by a buffer zone 32, as shown in FIG. 4.

As also shown in FIG. 4, a support tube 34 may be insertable into the bag 24 through the opening 28. The tube 34 may have a plurality of holes 36 along its length and provide an at least partially rigid channel which is open in cross-section. A lower end 38 of the tube 34 may be open or closed. The lower end 38 of the tube 34 can be in contact with the bag 24—alternatively, the lower end 38 of the tube 34 may be close to but not in contact with the V-shaped edge 30 of the bag 24. An upper end of the tube 34 may be secured to an insert 40 by any suitable method or means, and may be a simple push fit in the insert 40.

The insert 40 is partially insertable into the bag 24 through the opening 28 and is also partially insertable into the bottle 10 through the neck 14. Preferably, the insert is permanently fixed in a fluid tight manner to the sheets 26 around the opening 28, for example by heat or ultrasonic welding. The insert 40 and the bag 24 could alternatively be of unitary construction. The insert 40 is preferably irremovably fixed to the neck 14 by a simple push fit or any other suitable method or means but could alternatively be removable by a user to achieve a refillable system.

Figure 2:
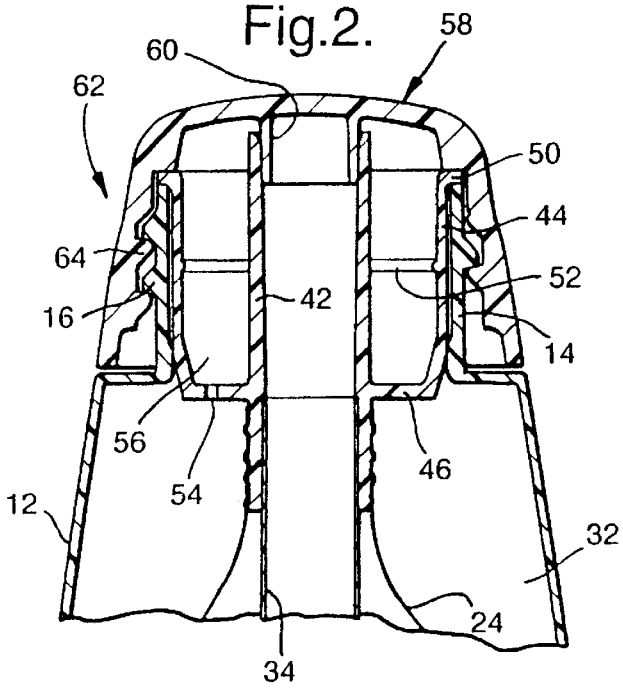
FIG. 2 is a fragmentary enlarged cross-sectional view showing the cap when secured to the bottle.
Figure 3:
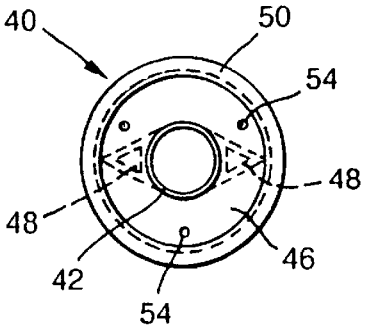
FIG. 3 is a plan view of the insert.
Figure 6:
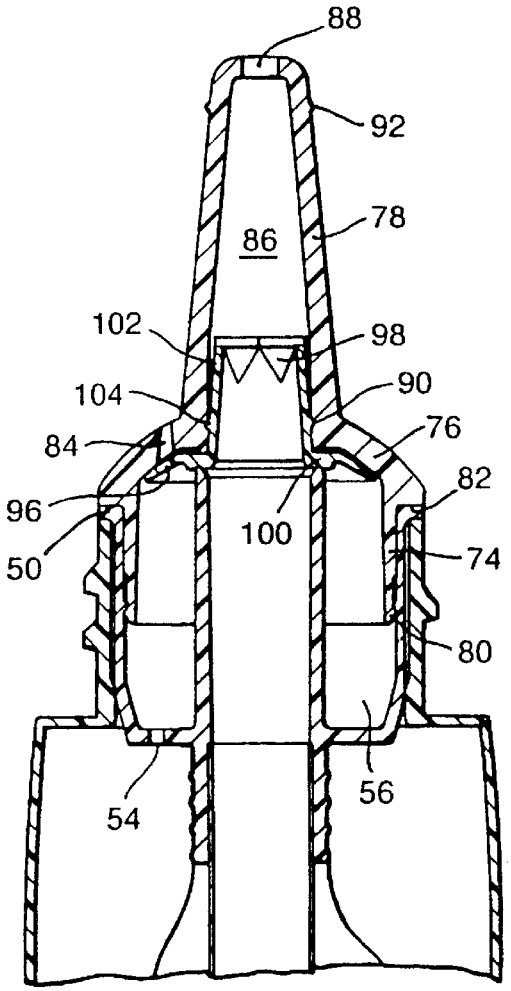
FIG. 6 is a fragmentary enlarged cross-sectional view of FIG. 5.

As shown in FIGS. 2, 4 and 6, the insert 40 may be a one-piece plastics moulding having a tubular member 42 which defines an orifice and extends centrally of a side wall 44, a transverse wall 46 and a pair of opposed lower sections 48.

The side wall 44 is shown with an outwardly extending flange 50 at its upper end, for limiting insertion of the insert 40 into the bottle 10, and an inwardly directed rib 52 at a position generally mid-way between the flange 50 and the transverse wall 46. The transverse wall 46 is shown with a plurality of holes 54 therethrough for joining the buffer zone 32 to an annular channel 56 defined between the tubular member 42 and the side wall 44 and thus surrounding the tubular member 42. The opposed lower sections 48 are shown as hollow, to prevent sinkage in moulding, and thereby facilitate the fluid tight fixing of the insert 40 to the bag 24.

A lower end of the tubular member 42 may be inwardly recessed for receiving the upper end of the tube 34 and an upper end of the tubular member 42 may be inwardly chamfered.

Typically the bag 24 will be supplied to a user when already partially filled with a first material, such as hydrogen peroxide. It will therefore be necessary to prevent the first material escaping through the tube 34 and the tubular member 42. A removable flip top cap could be provided for closing the upper end of the tubular member 42. Alternatively, the upper end of the tubular member 42 could be closed by a rupturable film seal. Preferably, however, a removable cap 58 is provided, as shown in FIG. 2.

The cap 58, which may again be a one-piece plastics moulding, may have a plug seal 60 for sealingly closing the upper end of the tubular member 42. A securing part 62 of the cap 58 could be an airtight fit with the neck 14 of the bottle 10. However, there are advantages in forming the securing part 62 of the cap 58 as a non-airtight fit. For example, there could be an internal thread 64 which is a breathable screw fit with the external thread 16 on the neck 14 of the bottle 10 to provide an air passageway to atmosphere from the annular channel 56.

One advantage is that, if hydrogen peroxide in the bag 24 became unstable and produced oxygen, the bag 24 could expand with air in the buffer zone 32 escaping through the holes 54 in the insert 40 and then between the threads 16 and 64.

Another advantage is that, if the buffer zone 32 were to be subjected to an unwanted pressure change, for example as a result of air travel, air could again either escape from or enter the buffer zone 32 by the above-indicated route.

The hair colouring kit as so far described allows a user to prepare a hair colouring composition or other flowable composition just prior to use.

In practice, at least a second material is added to the first material in the reservoir. If the reservoir had been supplied in an empty state, or had been emptied in a previous use, it would of course first be necessary to add some first material to the reservoir. In any event, the initially separated materials need to be allowed to mix.

As shown schematically, in FIG. 4, the second material may be stored in an entirely independent container 66. If the first material is hydrogen peroxide, the second material is likely to be a dye. As dyes can be oxygen sensitive, the container 66 may need to provide an excellent oxygen barrier. Moreover, if the dye is in the form of a gel, cream or paste, for example, the container 66 could need to be plastically deformable to allow a user to squeeze the dye therefrom. On the other hand, if the dye is in the form of a liquid, the dye might be able to exit the container 66 under the influence of gravity.

If the container 66 is resiliently deformable, the bag 24 is preferably inflated with air above the first material—if the container 66 is not resiliently deformable, the bag 24 is preferably deflated.

The user may be supplied with a plurality of the containers 66 and each of the containers 66 may contain a different material such as a different shade of hair colorant with the intention that one or more of the containers 66 are to be emptied into the reservoir to form a particular flowable composition such as a hair colouring composition of specifically selected shade.

It is desirable for the container 66, or each of the containers 66, to include a long nozzle 68 which can extend completely through the tubular member 42 into the tube 34. This can give good docking in that the container 66 is less likely to come apart from the bottle 10 even when the user is using both hands to squeeze the container 66. It can also promote good mixing in that the contents of the container 66 might be squirted from close range directly into the contents of the bag 24. Clearly, it will be necessary for the container 66 to be opened before insertion of the long nozzle 68 into the tubular member 42, and opening may be effected by breaking off, cutting off or twisting off the nozzle's tip 70 (shown in broken outline in FIG. 4).

It will be appreciated that, as the second material is emptied from the container 66 into the bag 24, the volume of any air in the bag 24 above the first material will be progressively reduced, and any such compressed air should be encouraged to escape to prevent the bag 24 from expanding.

If the nozzle 68 is a loose fit in the tubular member 42, the compressed air will escape through that loose fit. Alternatively, one or more splines could be formed along the length of the nozzle 68 and/or one or more air escape castellations could be formed on the dye container adjacent a base of the nozzle 68. Dependent on the nature of the second material in the container 66, and the dimensions, the compressed air might inject upwards through the second material to form an air pocket in the container 66 which expands as the air pocket in the bag 24 contracts.

Even if the bag 24 does expand, air in the buffer zone 32 would escape through the holes 54 in the transverse wall 46 of the insert 40, as previously described.

"After a sufficient amount of the second material has been added to the first material, the container 66 is removed from the bottle 10 and is either discarded or resealed and saved for future use."

As alternatives to adding the second material to the first material by decanting, the second material may be contained in a container which is formed with or located within the bag 24 and which is rupturable, for example by squeezing the body 12 of the bottle 10, or which is otherwise capable of allowing the second material to be added to the first material.

When the second material has been added to the first material, they are preferably mixed at this stage by shaking the bottle 10. It would be possible for the user to prevent escape of the contents of the bag 24 by placing a gloved finger over the upper end of the tubular member 42 whilst shaking. It may be more convenient, however, for the user to replace the cap 58 so that the plug seal 60 closes the upper end of the tubular member 42. In either case, the tube 34 acts to restrain the bag 24, while shaking and/or inverting the bottle 10, and thereby aids mixing by allowing the contents of the bag 24 to move more freely than the bag 24. It is believed that optimum mixing by shaking occurs if around 10% of the volume of the bag 24 is left as headspace. If the bag 24 and the body 12 of the bottle 10 are both translucent, it is possible to check visually whether or not mixing has been completed.

Figure 5:
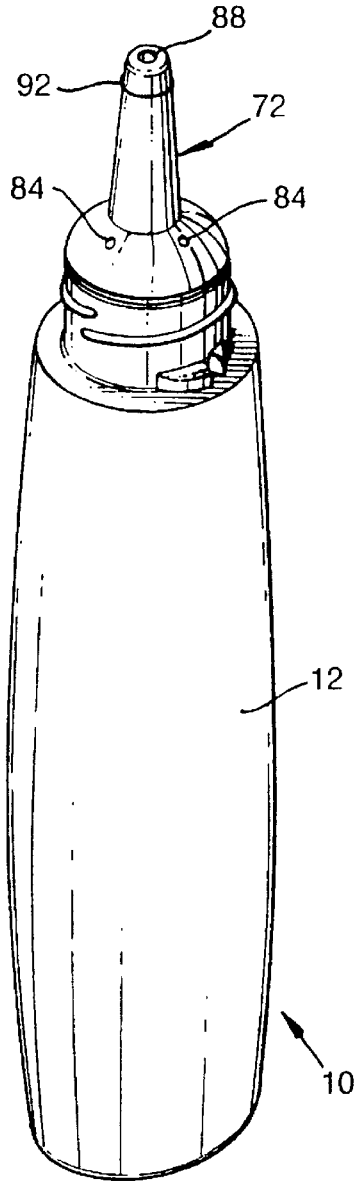
FIG. 5 is a perspective view showing the spout when secured to the bottle.

To prepare for discharge of the flowable composition formed by the first and the second materials, or more specifically the hair colouring composition formed by the hydrogen peroxide and the dye, the insert 40 is again exposed to allow a spout 72 to be attached to the insert 40, as shown in FIGS. 5 and 6.

The spout 72 may once again be a one-piece plastics moulding, here comprising a cylindrical portion 74 leading to a domed portion 76 which itself leads to a tapered portion 78. A bottom end of the cylindrical portion 74 is formed with an outwardly directed rib 80. A top end of the cylindrical portion 74 is formed adjacent a shoulder 82 presented by the domed portion 76. One or more, such as three, air inlets 84 extend through the domed portion 76 and may be equally circumferentially spaced around the domed portion 76. The tapered portion 78 is formed with an elongate passageway 86 which gradually narrows along its length from a larger lower end to a single outlet 88 at a smaller upper end. An annular recess 90 is formed in an inner surface of the tapered portion 78 near the larger lower end of the passageway 86. An annular rib 92 is formed on an outer surface of the tapered portion 78 near the smaller upper end of the passageway 86.

A valve member 94, which may be formed of a silicone polymer and may be of unitary construction, is attachable to the spout 72.

Preferably, the valve member 94 includes an inlet part in the form of an annular flapper valve 96 which acts as a one-way check valve to control entry of air through the air inlets 84.

Preferably, the valve member 94 also includes an, outlet part in the form of a central quadrolobe valve 98 which acts as a one-way check valve to control exit of hair colouring composition through the passageway 86. A quadrolobe valve 98 is preferred because it opens from the centre not the side and thus gives a smoother flow of hair colouring composition therethrough. However, as alternatives to a quadrolobe valve 98, the outlet part of the valve member 94 could be a flapper valve, an umbrella valve or a duckbill valve.

The flapper valve 96 and the quadrolobe valve 98 may be joined by an intermediate part including a transverse sealing wall 100 and a frusto-conical locating wall 102 whose outer surface has an annular rib 104.

The valve member 94 is easily attached to the spout 72 by pushing the quadrolobe valve 98 into the passageway 86 until the annular rib 104 on the valve member 94 engages with the annular recess 90 in the spout 72.

The spout 72 is then itself easily attached to the insert 40 by pushing the cylindrical portion 74 of the spout 72 into the annular channel 56 of the insert 40 until the rib 80 on the cylindrical portion 74 snaps passed the rib 52 on the insert 40, with an audible or at least tangible click, at which time the shoulder 82 of the spout 72 is brought into abutment with the flange 50 of the insert 40 and the sealing wall 100 of the valve member 94 is brought into sealing engagement with the upper end of the tubular member 42 of the insert 40.

In an alternative construction, the spout 72 can be attached to the insert 40 by a screw fit rather than the above-noted push fit.

The bottle 10 could be shaken after the spout 72 has been attached to the insert 40 in order to mix or re-mix the flowable composition.

In order to deliver the hair colouring composition from the bag 24 to the outlet 88 in the spout 72, from where the hair colouring composition is discharged in a line to for example the roots of a head of hair, the body 12 of the bottle 10 is squeezed by the user. This compresses the air in the buffer zone 32 but the compressed air cannot escape through the fluid passageway including the holes 54, the annular channel 56 and the air inlets 84 because the flapper valve 96 acts to close the air inlets 84. Instead, the compressed air acts to partly collapse the bag 24 so that some hair colouring composition is forced out through the fluid passageway including the tube 34, the tubular member 42, the frusto-conical locating wall 102 and the quadrolobe valve 98, which opens to let the hair colouring composition therethrough. When the user stops squeezing the body 12 of the bottle 10, the bottle 10 quickly reforms in shape so that the buffer zone 32 expands. The quadrolobe valve 98 closes to prevent suckback of the hair colouring composition beyond the quadrolobe valve 98 and the bag 24 maintains its partly collapsed state. Instead, air is sucked into the buffer zone 32 past the flapper valve 96 which opens to let air in through the air inlets 84.

Squeezing of the body 12 of the bottle 10 is repeated by the user with whatever pressure and frequency is deemed appropriate to the circumstances.

It will be appreciated that the holes 36 in the tube 34 can prevent the hair colouring composition becoming trapped, as the bag 24 is progressively collapsed to bring the sheets 26 of the bag 24 into contact with one another, and the tube 34 might itself collapse to allow flowable composition in the tube 34 to be discharged.

As the hair colouring composition is dispensed, the user may see through the at least translucent body 12 that the bag 24 is collapsing. This should reassure a user who feared that the hair colouring composition could run out without warning.

Although the reservoir for the first material may be a side sealed sachet, as hereinbefore described, the reservoir could take other forms—for example, an inner collapsible layer distinct from an outer deformable layer would also be provided by an inverting-half-bag bottle or a delaminating bottle, the latter preferably peeling progressively away from a neck thereof, or by a compression blown bag integrally moulded with the insert.

Moreover, although the valve member may be of unitary construction but dual function, as hereinbefore described, the valve member could take other forms—for example, separate valves could be provided for controlling exit of hair colouring composition and entry of air, the latter possibly being a simple air hole in the body of the bottle which a user closes with a finger.

Figure 7:
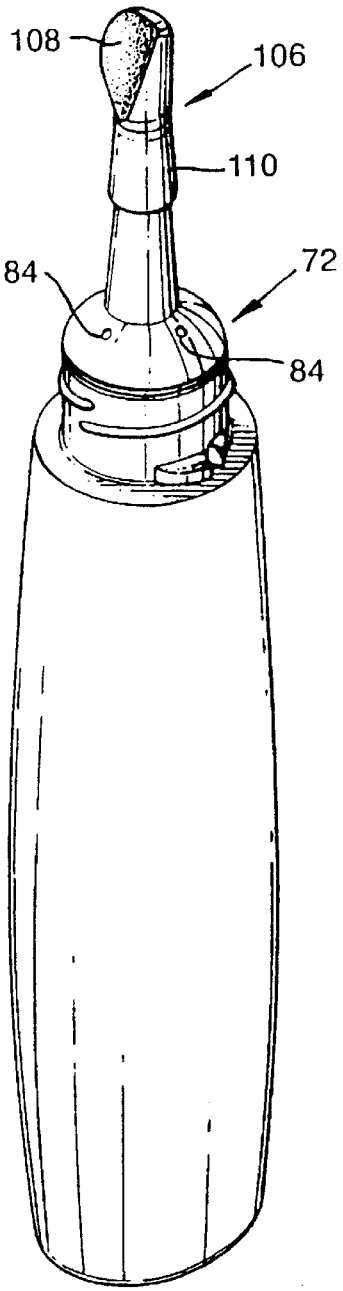
FIG. 7 is a perspective view similar to FIG. 5 but showing the sponge pad when secured to the spout.
Figure 8:
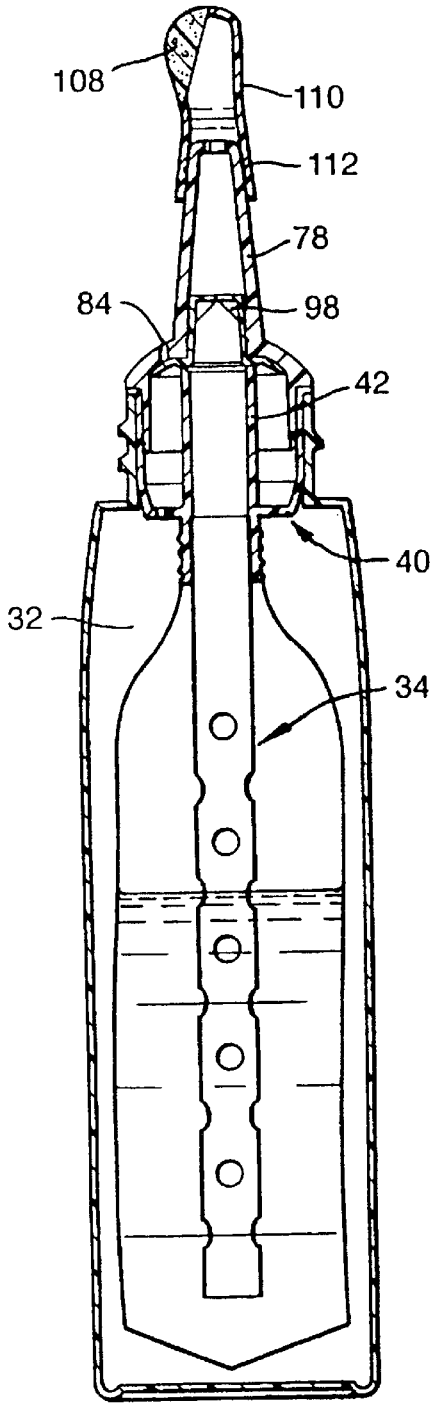
FIG. 8 is a cross-sectional view of FIG. 7.

Referring now to FIGS. 7 and 8, a surface applicator 106 is shown removably secured over the outlet 88 of the spout 72. More particularly, the surface applicator 106 may include a pad 108 of foam or sponge material having a resiliently compressible porous structure. Such a structure not only has a plurality of outlets, but allows hair colouring composition emerging from the outlet 88 to pass through the pad 108 and by careful manipulation be evenly spread along the hairline. The pad 108 may be located at or near an upper end of a carrier 110 with a lower half of the carrier 110 being frusto-conical in the direction leading from a smaller upper end to a larger lower end. An inner surface of the lower half of the carrier 110 may be formed with an annular recess 112 for detachably engaging with the annular rib 92 on the spout 72 when the carrier 110 is pushed onto the spout 72. The carrier 110 and the spout 72 may be mutually configured to avoid relative rotation. The pad 108 may present a curved face, to facilitate accurate application, with the curved face extending only partly around the circumference of an upper half of the carrier 110. If the pad 108 is formed of a plastics material, and the carrier 110 is also formed of a plastics material, the pad 108 may be fixed to the carrier 110 by use of an adhesive. Clearly, if the original surface applicator 106 is not to be cleaned and re-used, a range of surface applicators 106 could be provided which are either similar if intended to be disposable or different if intended to be interchangeable.

As shown in FIGS. 9 to 12, a brush/comb-like applicator 114 could be removably secured over the outlet 88 of the spout 72 instead of the surface applicator 106, the brush/comb-like applicator 114 including a housing 116 and a releasable unit 118.

The brush/comb-like applicator 114 could be a screw fit or a snap fit to the neck 14.

The housing 116 is yet another one-piece plastics moulding here defining, considered from the top, an aperture 120, a tapered open chamber 122 having a series of slotted webs 124 on its opposed major side walls, a guide tube 126 ensuring open communication into the chamber 122 from a chamber 128, a slot 130 at an upper end of the chamber 128, an internal thread 132 near a lower end of the chamber 128, and a pair of opposed lug means 134 at the lower end of the chamber 128.

The internal thread 132 is preferably strippable from a mould without screwing.

"The housing 116 is a removable screw fit with the bottle 10 by virtue of the internal thread 132 in the chamber 128 engaging the external thread 16 on the neck 14. As the housing 116 is progressively screwed on, the outlet 88 of the spout 72 enters the guide be 126. Finally, the lug means 134 can along the ramps 22 of the lug means 18 and then snap into the gaps 20 of the lug means 18. The snap may give an audible or at least tangible click to indicate that the housing 116 has been fully screwed onto the bottle 10. In this final position, with the lug means 18 and 134 interengaged, the chamber 122 opens in the direction of the major axis of the body 12, which it will be recalled is of generally oval section."

The releasable unit 118, which is the final component of the present hair colouring kit, may again be formed as a one-piece moulding of a plastics material such as polypropylene, with an additive such as silicone to give a low coefficient of friction.

The releasable unit 118 can be at least in part translucent to signal to a user that the flowable composition is about to be delivered.

The unit 118 comprises a support 136 which is generally planar and gradually tapers from a narrower upper end to a wider lower end. The narrower upper end has a resiliently deflectable catch 138 extending therefrom with a barb-like leading end 138*a*. The wider lower end has a rigid catch 140 extending therefrom with a barb-like leading end 140*a*. The periphery of the support 136 is formed with a skirt 142 which is of complementary outline to the opening of the chamber 122. A plurality of elongate parting members, such as substantially rigid teeth 144, project from the support 136 in a direct-ion opposed to the resiliently deflectable catch 138, the rigid catch 140 and the skirt 142. A plurality of outlets 146 for the flowable composition can extend through the support 136.

Figure 9:
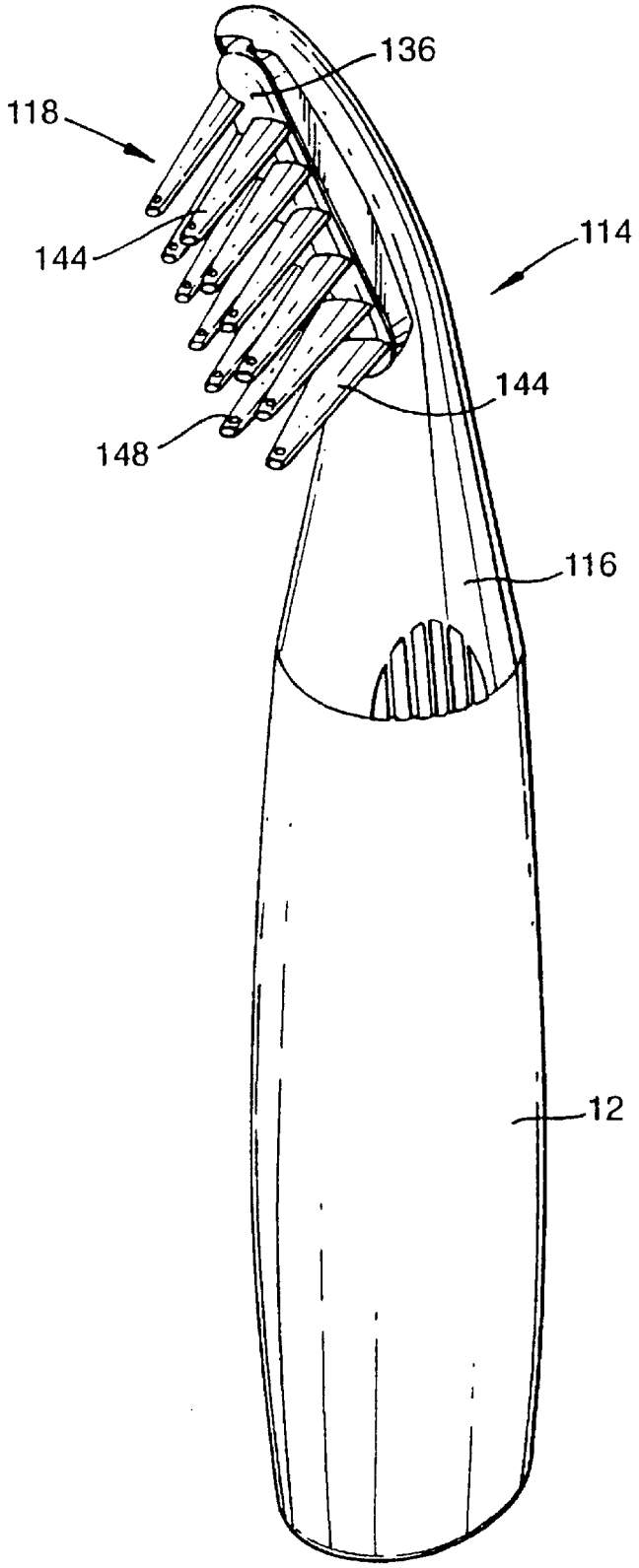
FIG. 9 is a perspective view showing the comb housing when secured to the bottle with the comb secured to the comb housing.
Figure 10:
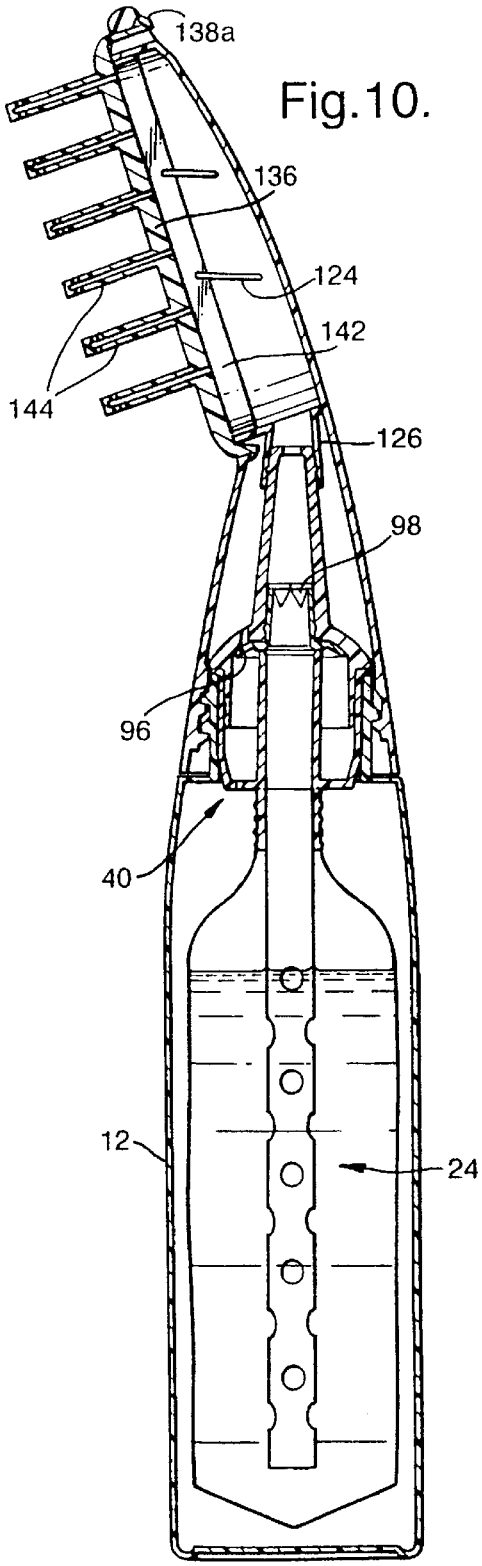
FIG. 10 is a cross-sectional view of FIG. 9.

As shown most clearly in FIG. 9, the teeth 144 may be arranged in two rows. The teeth 144 may but need not necessarily have generally triangular outlines of different transverse dimensions when viewed from the ends of the two rows. The transverse dimensions of the teeth 144 may progressively increase from the narrower upper end of the support 136 to the wider lower end of the support 136. Moreover, the teeth 144 of the different rows may be staggered with respect to one another, and may again have generally triangular outlines but now of generally similar thicknesses when viewed from the sides of the two rows.

Figure 11:
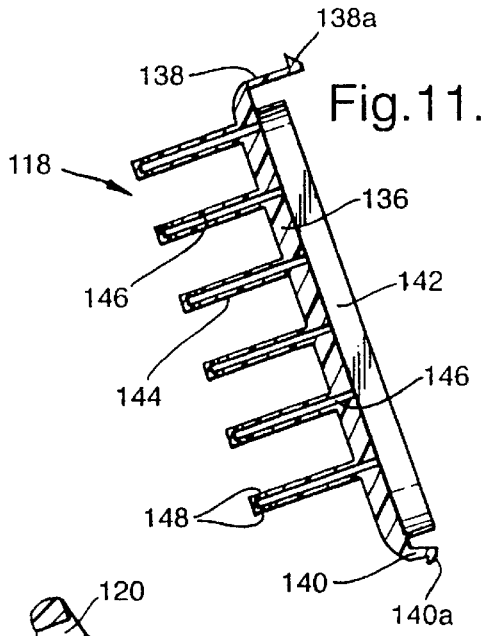
FIGS. 11 and 12 are, respectively, cross-sectional views of the comb and the comb housing before being secured together.
Figure 12:
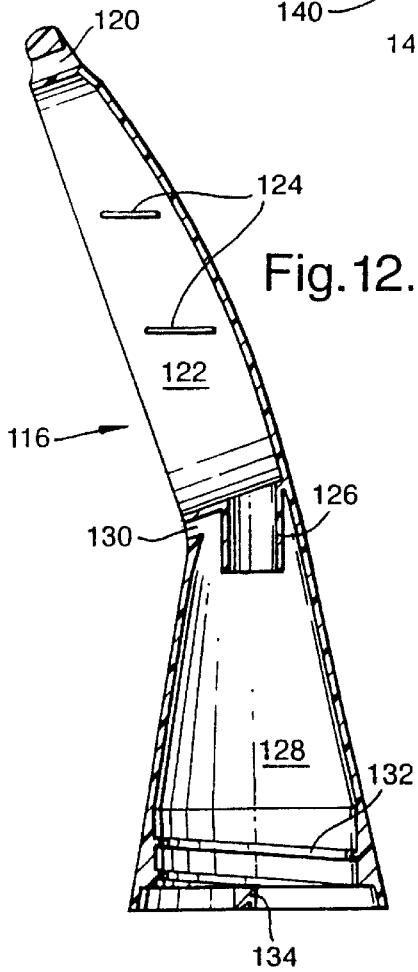

As shown most clearly in FIG. 11, at least two but possibly all of the outlets 146 further extend through respective ones of the teeth 144. However, it may be desirable for one or more of the outlets 146 not to extend through the teeth 144. For example, at least one outlet 146 may be positioned in the support 136 between adjacent ones of the teeth 144. At least two but possibly all of the outlets 146 which extend through the teeth 144 may emerge through orifices 148 at the free ends of the teeth 144.

In fact, although it is convenient to state that the orifices 148 are at the free ends of the teeth 144, the orifices 148 may be slightly set back from the free ends of the teeth 144, partly to avoid direct coating of the scalp, and partly as a result of a preferred moulding technique known as the passing face shut off technique, which allows the orifices 148 to be formed by a simple two-part mould without need of side pins.

To assemble the unit 118 with the housing 116, it is merely necessary to locate the barb-like leading end 140*a* of the rigid catch 140 in the slot 130 and then pivot. This brings the free edge of the skirt 142 into engagement with the slotted webs 124 and also deflects the barb-like leading end 138*a* of the catch 138 to allow entry of the catch 138 into the aperture 120. The unit 118 is fully secured to the housing 116 when the barb-like leading end 13*a* of the catch 138 emerges from the aperture 120 to snap engage with the material of the housing 116 around the aperture 120.

To remove the unit 118 from the housing 116, the reverse procedure is followed. The catch 138 is releasable by finger pressure. Alternatively, it may be possible to release the catch 138 by rolling the housing 116 over a hard surface in a manner such that the hard surface knocks the barb-like leading end 138*a* of the catch 138 back into the aperture 120. It will be appreciated that release of the catch 138 occurs remotely of the orifices 148.

One reason for removing the unit 118 from the housing 116 may be to facilitate cleaning of any residual hair colouring composition.

Another reason for removing the unit 118 from the housing 116 may be to allow replacement by another unit 118 of different type. For example, it may be desirable to replace the substantially rigid teeth 144, which give a comb-like construction, by either a brush-like construction including a plurality of resiliently flexible bristles, or a sponge-like construction or, indeed, another comb-like construction in which there are teeth and/or orifices of different dimensions and/or different configurations. This may facilitate thorough dispersal of dispensed hair colouring composition in different situations, such as different hair lengths or different hair types.

The dimensions, positions and shapes of the orifices 148 may be changed, in different units 118, dependent on the rheology of the hair colouring composition, or on the need for different colouring results such as root coverage, streaking or highlighting.

As a general matter, relevant to all of the present disclosure, the first container in which the first material is to be held can be construed as including the bottle when fitted with any one or combination of the different applicators.

As another general matter, relevant to all of the present disclosure, the flowable composition can be capable of demonstrating pseudo-plastic flow behaviour, here meaning that the flowable composition decreases in viscosity as it is sheared and, once the shearing has stopped, the internal structure of the flowable composition (which was responsible for the original viscosity) rebuilds very quickly causing an increase in viscosity approaching that of the original viscosity.

The flowable composition should be capable of the above-noted pseudo-plastic flow behaviour within a shear strain rate range of $0.01s^{-1}$ to $10{,}000s^{-1}$, which is the most probable shear strain rate range to be encountered when the flowable composition is a hair colouring composition.

An example of a suitable flowable composition could have a viscosity of no less than 0.01 Pa.s (preferably no less than 0.15 Pa.s) when measured at a shear strain rate of $2000s^{-1}$ and no more than 5 Pa.s (preferably no more than 1.4 Pa.s) when measured at a shear strain rate of $10s^{-1}$.

What is claimed is:

1. An applicator system, for use in delivering a flowable composition, comprising:

(a) a container including an inner collapsible layer distinct from an outer deformable layer, the inner collapsible layer defining a reservoir, and the outer deformable layer being separated from the inner collapsible layer by a buffer zone;

(b) a dispenser including a first passageway distinct from a second passageway, the first passageway being in communication with the buffer zone and the second passageway being in communication with the reservoir; and (c) valve means including an inlet part which acts as a one-way check valve operable to control entry of air into the buffer zone through the first passageway and including an outlet part which acts as a one-way check valve to control exit of flowable composition from the reservoir through the second passageway; wherein the valve means is of unitary construction.

2. An applicator system according to claim 1, wherein the inner collapsible layer comprises a flexible bag.

3. An applicator system according to claim 1, wherein the inlet part of the valve means controlling the first passageway is a flapper valve.

4. An applicator system according to claim 3, in which the first passageway includes a plurality of circumferentially spaced air inlets and the flapper valve is of annular shape.

5. An applicator system according to claim 1, wherein the outlet part of the valve means controlling the second passageway comprises a quadrolobe valve, a flapper valve, an umbrella valve, or a duckbill valve.

6. An applicator system according to claim 5, wherein the outlet part of the valve means controlling the second passageway is a quadrolobe valve.

7. An applicator system according to claim 6, wherein the quadrolobe valve is a push fit within the second passageway.

8. An applicator system according claim 1, wherein the valve means is a push fit with the dispenser.

9. An applicator system according to claim 1, wherein the dispenser is a push fit with the container.

10. An applicator system according to claim 9, wherein the dispenser is a push fit within an insert, and the insert is a push fit within a neck of the container.

11. An applicator system according to claim 10, wherein the insert has an annular channel surrounding a tubular member, with the annular channel including at least one opening forming part of the first passageway, and the tubular member contacting the valve means and forming part of the second passageway.

12. An applicator system according to claim 1, wherein the flowable composition is selected from the group consisting of hair colorants, medicaments, foodstuffs, cleaning fluids, cosmetics, adhesives, and lubricants.

13. An applicator system according to claim 12, wherein the flowable composition is selected from the group consisting of hair colorants, pet care medicaments, cake mixes, cleaning fluids for garment care, cleaning fluids for carpet care, body lotions, moisturizes, adhesives, and lubricants.

14. An applicator system according to claim 13, wherein the flowable composition is a hair colorant.

* * * * *

UNITED STATES PATENT AND TRADEMARK OFFICE

CERTIFICATE OF CORRECTION

PATENT NO. : 6,505,986 B1
DATED : January 14, 2003
INVENTOR(S) : Reuben Earl Oder It is certified that error appears in the above-identified patent and that said Letters Patent is hereby corrected as shown below:

Column 9,
Line 5, "guide be" should read -- guide tube --.
Line 6, "can" should read -- cam --.

Column 12,
Line 23, "moisturizes" should read -- moisturizers --.

Signed and Sealed this

Thirty-first Day of May, 2005

JON W. DUDAS
*Director of the United States Patent and Trademark Office*